United States Patent [19]

Moss

[11] 4,375,362

[45] Mar. 1, 1983

[54] GASIFICATION OF ASH-CONTAINING SOLID FUELS

[75] Inventor: Gerald Moss, Wantage, England

[73] Assignee: Exxon Research and Engineering Co., Florham Park, N.J.

[21] Appl. No.: 308,608

[22] Filed: Oct. 5, 1981

Related U.S. Application Data

[63] Continuation of Ser. No. 60,852, Jul. 26, 1979, abandoned.

[30] Foreign Application Priority Data

Jul. 28, 1978 [GB] United Kingdom ..... 31450/78

[51] Int. Cl.[3] ..... C10J 3/54

[52] U.S. Cl. ..... 48/197 R; 48/209; 48/210

[58] Field of Search ..... 48/197 R, 202, 203, 48/206, 210, 209; 252/373

[56] References Cited

U.S. PATENT DOCUMENTS

| | | | |
|---|---|---|---|
| 2,971,830 | 2/1961 | Kawai et al. | 48/206 |
| 3,804,606 | 4/1974 | Archer et al. | 48/197 R |
| 3,855,070 | 12/1974 | Squires | 201/23 |
| 3,870,480 | 3/1975 | Moss | 48/71 |
| 3,957,458 | 5/1976 | Squires | 48/203 |
| 3,963,457 | 6/1976 | Hess | 48/202 |
| 3,969,089 | 7/1976 | Moss et al. | 48/197 R |
| 3,970,434 | 7/1976 | Gasior et al. | 44/1 F |
| 3,981,690 | 9/1976 | Chen et al. | 48/73 |
| 4,017,272 | 4/1977 | Anwer et al. | 48/197 R |
| 4,154,581 | 5/1979 | Nock et al. | 48/197 R |

FOREIGN PATENT DOCUMENTS

| | | |
|---|---|---|
| 321422 | 11/1929 | United Kingdom . |
| 676615 | 2/1948 | United Kingdom . |
| 661560 | 11/1951 | United Kingdom . |
| 723332 | 2/1955 | United Kingdom . |
| 964776 | 7/1964 | United Kingdom . |
| 1047711 | 11/1966 | United Kingdom . |
| 1066340 | 4/1967 | United Kingdom . |

*Primary Examiner*—Peter F. Kratz
*Attorney, Agent, or Firm*—Joseph J. Allocca

[57] ABSTRACT

Ash-contaminated solid or semi-solid fuel is passed into the bottom zone of a fluidized bed gasifier, preferably containing CaO to fix labile sulfur moieties, and gasified at a temperature below the ash-softening point. The resulting char and ash of relatively low size and/or weight pass to a top zone of the bed wherein the char is gasified at a temperature above the ash-softening point whereby a substantial proportion of the ash sticks to and agglomerates with solids in the top zone until the particle size and/or weight of the resulting agglomerates causes them to sink to the bottom of the gasifier from where they can be recovered. The hot gases leaving the top of the gasifying bed have a reduced burden of entrained ash, and may be cooled to prevent any entrained ash adhering to downstream equipment through which the gases pass.

14 Claims, 1 Drawing Figure

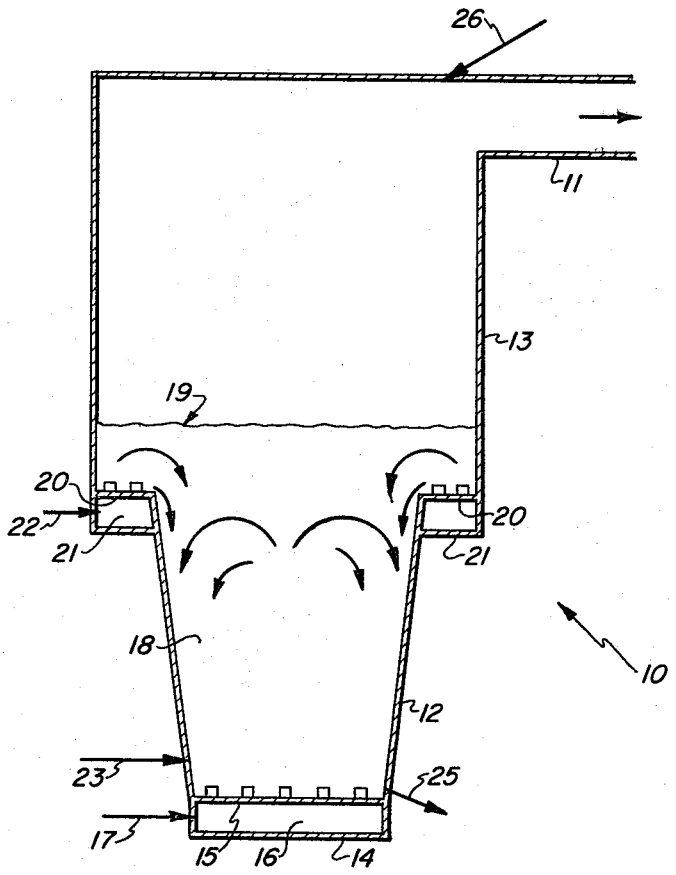
26
11
13
19
20
22
21
20
21
18
10
12
23
25
17
15
16
14

GASIFICATION OF ASH-CONTAINING SOLID FUELS

This is a continuation of application Ser. No. 060,852, filed July 26, 1979 now abandoned.

The present invention relates to the gasification of ash-containing solid or semi-solid fuels. By "gasification" is meant the conversion of the fuel to a combustible gas.

Gasification of a fuel is effected by partial oxidation of the fuel at an elevated temperature employing an oxidizing gas containing free oxygen and/or a source of oxygen, such as steam, $CO_2$, inter alia.

It has been proposed to gasify a fuel by passing the fuel into a bed of fluidizable particles at an elevated gasification temperature, the particles being fluidized by an upwardly-passing stream of gas resulting from the introduction into the bottom of the bed of the oxidizing gas, the amount of the latter being insufficient for complete oxidation of the oxidizable components of the fuel.

Most solid fuels are associated with non-combustible solid material, hereinafter termed "ash" for convenience. The ash may be of some inconvenience because during the gasification process, it is entrained in the combustible gas product due to its very fine size (this is particularly the case with fuels such as lignite wherein the relatively high water content causes the ash-forming materials to break up under the pressure of the steam produced on heating the lignite) and/or it softens and forms sintered deposits in the gasification equipment, and also in conduits and apparatus through which hot combustible gas containing entrained ash passes.

The present invention provides a method of converting an ash-containing solid or semi-solid fuel to a combustible gas, comprising the steps of passing particles of the fuel into a first zone of a single conversion bed containing fluidized solids which are fluidized by upwardly passing gas, the first zone being at a temperatures sufficiently high for converting at least some of the fuel to combustible gas and vapour phase precursors thereof but below the range of temperatures at which fuel ash softens, unconverted fuel particles of reduced size and/or weight together with at least some associated ash being upwardly carried to a second zone of the conversion bed above the first zone wherein the particles of the second zone are fluidized by an upwardly-passing conversion gas, the second zone being at a temperature at which fuel ash softens whereby to convert at least some of the unconverted fuel particles in the second zone to gas phase products and to cause at least some of the fuel ash to agglomerate and/or to stick to solids in the bed so that a reduced quantity of fuel and ash is elutriated out of the conversion bed and so that bed solids comprising agglomerated and/or adhered ash sink to a bottom region of the first zone of the conversion bed from where they can be withdrawn.

Preferably a gas containing free oxygen is passed from the bottom of the first zone of the fluidized conversion bed, and preferably a gas containing free oxygen is passed into the second zone of the fluidized conversion bed.

The ash-containing solid fuel may comprise coal and/or lignite and/or peat.

The first zone of the conversion bed may comprise particles comprising calcium oxide, optionally in chemical and/or physical admixture with magnesium oxide (e.g. de-carbonated dolomite) whereby sulfur in the ash-containing fuel is fixed in the particles as a solid compound comprising calcium and sulfur (e.g. CaS). Preferably, the temperature in the first zone is in the range of from 840° C. to 970° C. preferably from 850° C. to 950° C., e.g. about 900° C. so that gasification proceeds at a reasonable rate and a major proportion of the labile sulfur of the fuel (i.e. the sulfur that would normally appear in the combustible gas) is fixed in the particles.

The activity of the CaO-containing particles in the first zone to fix sulfur tends to diminish as the amount of available CaO decreases. Hence, it is preferred to maintain the amount of active CaO in the bed at a high level, e.g. greater than 70 mol %, preferably greater than 90 mol %, e.g. 93–95 mol %. In order to maintain an effective inventory of active CaO in the first zone, it is preferred to cause particles to past from one region (e.g. a top region) of the first zone to one region (e.g. a bottom region) of a regenerating zone wherein the particles are treated under such conditions that at least some solid compound comprising calcium and sulfur is converted, with the liberation of sulfur moieties, to calcium oxide which is active for fixing further amounts of sulfur from fuel under the conditions of the conversion zone, and particles comprising active calcium oxide are caused to circulate from a second region (e.g. a top region) of the regenerating zone to a second region (e.g. a bottom region) of the first zone of the conversion bed for further use in fixing sulfur from the ash-containing solid fuel. Preferably, the particles in the regenerating zone are contained in a bed which is fluidized by passing an oxygen-containing gas (conveniently air) into the base thereof, and the temperature in the bed being maintained in the range of from 850° C. to 1150° C. The following exothermic empirical reaction takes place:

$$2CaS+3O_2 \rightarrow 2CaO+2SO_2$$

Preferably the plan area of the first zone of the conversion bed increases with increasing height above the bottom thereof. The plan area of the second zone of the conversion bed may be greater than the maximum plan area of the first zone.

The gas product leaving the top level of the conversion bed may contain entrained ash at temperatures above the softening temperature. In order to avoid or mitigate problems arising from the deposition of sintered ash in conduits and/or apparatus through which the combustible gas product passes, it is preferred to cool the gas product to a temperature below the ash softening or sintering temperature as the gas is passed from the dilute phase space above the conversion bed.

The invention is now further described with reference to the accompanying drawing which is a diagrammatic vertical cross-sectional elevation of the principal parts of a gasification apparatus in which the invention may be performed.

The apparatus comprises a gasifier vessel generally indicated by reference 10 which has a gas outlet through which the combustible gas product can pass to a conduit 11 for de-dusting in a cyclone system and/or other appropriate solids-separation equipment (not shown) before being either burned to produce heat or chemically modified to provide desired chemical products.

The vessel 10 is formed of a bottom section 12 which is upwardly flared and a top section 13 which is substantially of constant cross-section, in plan, which cross-sectional area is greater than the maximum area of the bottom section 12.

A short distance above the base 14 of the bottom section 12, an air distributor 15 extending across the vessel 12 defines a plenum 16 into which air, optionally containing steam, is passed from air line 17. The vessel contains a bed 18 of particles of lime (or other CaO-containing material) supported on the air distributor 15 and extending to a top level 19, during operation, which is above the bottom of section 13. The gap between the top of the section 12 and the bottom of section 13 is bridged by an air distributor 20 which distributes air into the bed material from a plenum 21 beneath the distributor 20, the plenum being supplied with air from line 22.

Pulverized or finely divided coal is passed into the bottom zone of the bed 18 from one (or more) lines 23, and air is distributed into the bed 18 from distributor 15 at such a rate as to fluidize the particles of the bed but to avoid raising the lime-containing particles above the top of the bottom section 12. The amount of oxygen in the air distributed into the bottom zone is sufficient to maintain the bottom zone temperature at about 900° C. by partial combustion of at least some of the coal. At this temperature, the coal de-volatilizes, and volatile materials pass upwardly with the fluidizing gas stream, labile sulfur in the volatile materials, the coal, and any decomposition products thereof tending to react with the lime to form calcium sulfide. The upwardly increasing cross sectional area of the bottom section 12 maintains a suitable gas velocity profile for maintaining the lime particles in the bottom section 12.

Devolatilized coal char and ash particles, being smaller and/or lighter than the lime particles, are carried upwardly by the fluidizing gases into the upper zone of the bed 18 above the level of the air distributor 22. Air is distributed into the upper bed zone from the distributor 22 at a rate sufficient to gasify the char at a temperature above the fusion temperature of the ash. The temperature is the upper bed zone may be in the range 1100° C. to 1200° C., or higher or lower, depending on the fusion temperature of the ash. At such temperatures, the ash particles stick to form ash agglomerates which are too large and/or too heavy to remain fluidized. The agglomerates sink in the bed 18 and give up heat to the lower zone of the bed thereby improving the thermal efficiency of the gasification bed. The agglomerates are withdrawn from the bottom of bed 18 either continuously or intermittently via a suitable drain line 25 of any type which is known to, or can be devised by, those skilled in the art.

The combustible gas leaving the top level 19 of the bed 18 will contain entrained fine ash at the temperature of the upper zone of the bed 18. In order to prevent such hot, fine ash sticking to and/or sintering on, equipment outside the vessel 13, a cooling fluid which may be cool flue gas (obtained by burning the combustible gas) and/or steam is injected into the top of the vessel 10 via line 26 immediately before the gas passes through the gas outlet into the conduit 11. The gas entering conduit 11 is at a temperature below the softening point of the entrained ash and the latter may be separated from the gas by conventional means, e.g. a cyclone system, leaving a substantially solids-free gas available for the intended use.

As depicted in the drawing, the bottom section 12 is of symmetrical frusto-conical form and the top section 13 is of co-axial cylindrical form, the distributor 22 being of annular form. It will be appreciated that this construction is merely intended to be illustrative and not limitative of the form of apparatus which can be employed to practise the invention. In an alternative arrangement, the bottom section has one side which slopes downwardly and inwardly, the other sides being substantially vertical so that substantially no bed fluidization takes place in the vicinity of the sloping side. In this region, there will be a downflow of solids, including agglomerates from the upper bed zone, the latter accumulating at the foot of the sloping wall and finer particles being recirculated upwardly in the bed 18. In another arrangement, all the walls of the bottom section may be substantially vertical but provided with channels which slope and converge downwardly. The substantial absence of fluidization in such channels promotes a downflow of agglomerates which then concentrate or accumulate at the bottom of bed 18 from where they can be withdrawn via one or more respective ash drain lines (equivalent to drain line 25).

What is claimed is:

1. A method of converting an ash-containing solid or semi-solid fuel to a combustible gas comprising establishing a single fluidized fuel conversion bed having a bottom zone operating at fuel conversion conditions including a temperature below ash-softening temperatures, and an upper zone operating at fuel conversion conditions including ash-softening temperatures, feeding all of the fuel directly into the bottom zone whereby at least some of the fuel is converted in the bottom zone to combustible gas and vapor-phase precursors thereof, and whereby unconverted solid particles of fuel material of reduced size and/or weight together with at least some associated ash are upwardly entrained into the upper zone wherein at least some of the unconverted solid fuel material from the bottom zone is converted to combustible gas so that a reduced quantity of fuel material is elutriated from the bed and wherein at least some of the ash softens and agglomerates and/or sticks to solids in the upper bed zone so that a reduced quantity of ash is elutriated out of the conversion bed and so that bed solids comprising agglomerated and/or adhered ash sink from the upper zone of the bed to a bottom region of the bottom zone of the bed from where they can be withdrawn.

2. The method according to claim 1 in which a gas containing free oxygen is passed into the bottom of the bottom zone of the fluidized bed.

3. The method according to claim 1 in which a gas containing free oxygen is passed into the upper zone of the fluidized bed.

4. The method according to claim 1 in which the ash containing fuel is coal and/or lignite and/or peat.

5. The method according to claim 1 in which at least the bottom zone of the conversion bed comprises particles comprising calcium oxide, whereby sulfur in the ash-containing fuel is fixed in the particles as a solid compound comprising calcium and sulfur.

6. The method according to claim 1 in which at least the bottom zone of the conversion bed comprises particles comprising calcium oxide in chemical and/or physical admixture with manganese oxide, whereby sulfur in the ash-containing fuel is fixed in the particles as a solid compound comprising calcium and sulfur.

7. The method according to claim 5 or 6 in which the temperature in the bottom zone is in the range of from 840° C. to 970° C.

8. The method according to claim 5 or 6 in which the temperature in the bottom zone is in the range of from 850° C. to 950° C.

9. The method according to claim 5 or 6 in which particles are caused to pass from one region of the bottom zone to the one region of a regenerating zone wherein the particles are treated under such conditions that at least some solid compound comprising calcium and sulfur is converted, with the liberation of sulfur moieties to calcium oxide which is active for fixing further amounts of sulfur from fuel under the conditions of the conversion bed, and in which particles comprising active calcium oxide are caused to circulate from a second region of the regenerating zone to a second region of the bottom zone of the conversion bed for further use in fixing sulfur from the ash-containing solid fuel.

10. The method according to claim 1 in which the plan area of the bottom zone increases with increasing height above the bottom of the conversion bed.

11. The method according to claim 1 in which the plan area of the upper zone of the conversion bed is greater than the maximum plan area of the bottom zone of the conversion bed.

12. The method according to claim 1 in which the gas product from the conversion bed is cooled to a temperature below the ash softening or sintering temperature on leaving the dilute phase space above the conversion bed.

13. The method as in claim 5 in which the fluidizing conditions in the fluidized bed are such as to substantially avoid raising particles comprising CaO from the lower zone into the upper zone.

14. The method as in claim 6 in which the fluidizing conditions in the fluidized bed are such as to substantially avoid raising particles comprising the CaO and MgO from the lower zone into the upper zone.

* * * * *